US008246440B2

(12) United States Patent
Stewart

(10) Patent No.: US 8,246,440 B2
(45) Date of Patent: Aug. 21, 2012

(54) DISPLAY DEVICE FOR GAMING MACHINE HAVING A SPINNING REEL

(75) Inventor: Scott Monroe Stewart, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 497 days.

(21) Appl. No.: 12/333,811

(22) Filed: Dec. 12, 2008

(65) Prior Publication Data

US 2009/0227370 A1 Sep. 10, 2009

Related U.S. Application Data

(60) Provisional application No. 61/013,569, filed on Dec. 13, 2007.

(51) Int. Cl.
*G07F 17/34* (2006.01)

(52) U.S. Cl. ..... 463/20

(58) Field of Classification Search ..... 463/20, 463/21

See application file for complete search history.

(56) References Cited

U.S. PATENT DOCUMENTS

| | | | | |
|---|---|---|---|---|
| 5,388,829 | A * | 2/1995 | Holmes | 273/143 R |
| 6,086,066 | A * | 7/2000 | Takeuchi et al. | 273/143 R |
| 6,227,971 | B1 | 5/2001 | Weiss | |
| 6,464,581 | B1 | 10/2002 | Yoseloff et al. | |
| 6,869,359 | B1 | 3/2005 | Mathews | |
| 2003/0130027 | A1 | 7/2003 | Aida | |
| 2004/0102244 | A1 | 5/2004 | Kryuchkov et al. | |
| 2004/0142737 | A1 | 7/2004 | Gauselmann | |
| 2004/0222585 | A1 | 11/2004 | Moffett | |
| 2005/0054432 | A1 | 3/2005 | Amos | |
| 2005/0064927 | A1 | 3/2005 | Kaminkow | |
| 2005/0124405 | A1 | 6/2005 | Nordman | |
| 2005/0187007 | A1 | 8/2005 | Kuroiwa | |
| 2005/0215301 | A1 | 9/2005 | Seelig et al. | |
| 2005/0227755 | A1 | 10/2005 | Nordman | |
| 2006/0030390 | A1 | 2/2006 | Okada | |
| 2006/0073867 | A1 | 4/2006 | Rothkranz | |
| 2006/0073872 | A1 | 4/2006 | B-Jensen et al. | |
| 2006/0178200 | A1 | 8/2006 | Shiraishi | |
| 2007/0123390 | A1 | 5/2007 | Mathis | |
| 2007/0167215 | A1 | 7/2007 | Majima et al. | |

FOREIGN PATENT DOCUMENTS

| | | |
|---|---|---|
| CA | 2315506 | 3/2001 |
| CA | 2564559 | 6/2007 |
| EP | 1492063 | 12/2004 |
| EP | 1522974 A1 | 4/2005 |
| EP | 1531434 | 5/2005 |
| EP | 1635306 | 3/2006 |
| EP | 1522974 B1 | 11/2009 |
| GB | 2117155 | 10/1983 |

(Continued)

*Primary Examiner* — Thomas L Dickey
(74) *Attorney, Agent, or Firm* — McAndrews, Held & Malloy, Ltd.

(57) ABSTRACT

The present invention relates to a gaming machine having mechanical spinning reels and display units mounted inside the reels that are driven between a retracted position and a forward position. The display unit is displaced inwardly toward a central axis of the reel when located in the retracted position, and in this position the reel is free to rotate in response to a wager being placed. The display unit is located closer toward the outer periphery of the reel when in the forward position and in registration with a variable display when the reel is stopped. Movement of the display unit between the retracted and forward positions minimizes parallax effects and increases enjoyment for a player.

18 Claims, 6 Drawing Sheets

FOREIGN PATENT DOCUMENTS

| | | |
|---|---|---|
| GB | 2253299 | 9/1992 |
| GB | 2394106 | 4/2004 |
| GB | 2421624 | 6/2006 |
| GB | 2429320 | 2/2007 |
| TW | 539567 B | 7/2003 |
| WO | 2004025586 | 3/2004 |
| WO | 2004029893 | 4/2004 |
| WO | 2007053349 | 5/2007 |

* cited by examiner

DISPLAY DEVICE FOR GAMING MACHINE HAVING A SPINNING REEL

RELATED APPLICATIONS

This application claims priority to U.S. Provisional Patent Application No. 61/013,569, having a filing date of Dec. 13, 2007, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

The present invention relates to gaming machines and display devices therefor.

BACKGROUND OF THE INVENTION

In the past, gaming machines with mechanical spinning reels have been driven by spring loaded mechanisms that are released by pulling the handle of the gaming machine. A characteristic of this type of mechanism is that the reels stop spinning on a random basis and thus, the outcomes of the games played are also random. More recently, spinning reels have been driven by stepper motors that enable the stop position of the reels and, therefore, the allocation of payouts to be accurately controlled. In addition, electronic gaming machinery is now being used to simulate reels on display screens that appear to a player to be spun and stopped using computer generated graphics. However players are still attracted to, and enjoy playing, gaming machines having mechanical reels.

BRIEF SUMMARY OF THE INVENTION

According to the present invention there is provided a display device for a gaming machine comprising:

a structural support;

a display for displaying images that relate to a game that can be played on the gaming machine;

a mechanical reel mounted to the structural support for rotational movement relative to the display, the mechanical reel having a outer periphery defining a plurality of image positions including at least one variable display position at which the display is operable to display content; and an actuator for moving the display between i) a first position in which the display is displaced from the outer periphery of the reel, and ii) a second position in which the display is located closer toward the outer periphery of the reel and in registration with the variable display position to display content.

Although it is possible that the display may be located outside the reel when in the first position, preferably the display is located inside the reel when in the first position.

In an embodiment, when the display is in said first position the reel can be rotated.

In an embodiment, the first position is a retracted position in which the display is displaced inwardly toward a central axis about which the outer periphery of the reels rotates. In other words, the display is located in a direction toward the centre of the reel.

In an embodiment, the second position is an advance position in which the display is located toward to the outer periphery of the reel allowing the images on the display to be observed when the reel is stopped.

In an embodiment, the outer periphery of the reel is defined by a peripheral wall and the variable display position of the outer periphery defines an opening and when the display is located in the second position, the display is received by the opening.

Although it is possible that the entire display or only part of the display may protrude outside the peripheral wall when located in the second position, in an embodiment the display is located inside an outermost face of the peripheral wall when located in the second position.

In an embodiment, at least part of the display is planar with the outermost face of the peripheral wall.

Even more suitably, the display has a flat face or curved face.

According to one embodiment, the display is selected from the group comprising a TFT (thin film transistor displays), and OLED (organic light emitting diode display) and an LCD (liquid crystal display).

According to an alternative embodiment, the display includes a projector component. In an embodiment, the projector component projects directly to the variable displaying position. In an embodiment, the projector component projects to the variable display position.

In an embodiment, the reel comprises a plurality of variable display positions.

In an embodiment, the display device comprises a plurality of displays.

In an embodiment, the actuator is any one or a combination of: a ram mechanism include an electronic screw mechanism, hydraulic mechanism or pneumatic mechanism; an electric motor; a spring including a compression spring or tensile spring; an electromagnetic actuator; a rack and pinion mechanism; a block and cable mechanism; a pulley mechanism; a gear mechanism; a gear and chain mechanism; a lever mechanism; a sliding mechanism; a pneumatic mechanism such as a suction mechanism or any other drive mechanism capable of moving the display between first and second positions.

In an embodiment, the display device comprises an actuator controller, such as a microprocessor, that is operable to move the display from the first position to the second position when the reel is located in the desired stop position.

In an embodiment, the actuator controller is also operatable to move the display between the first and second positions in co-ordination with rotation of the reel and stopping of the reel.

In an embodiment, when the reel is located in the desired stop position and the display located in the second position, prior to rotation of the reel, the actuator controller is operable to move the display from the second position to the first position.

In an embodiment, the display device comprises a stop mechanism arranged to stop the mechanical reel at a desired position.

In an embodiment, the display device comprises a driver to drive the reel for rotational positioning relative to the display.

In an embodiment, the display device comprises a stepper motor that drives the mechanical reel and a drive controller, such as a microprocessor, operable to stop the mechanical reel at a desired stop position.

In an embodiment, the drive controller and actuator controller communicate such that the actuator controller moves the display from the first position to the second position when the drive controller has stopped the reel at a desired stop position.

In an embodiment, the structural support comprises a first support member to which the mechanical reel is mounted and a second support member to which the display is mounted.

According to the present invention there is also provided an electronic gaming machine comprising:

a gaming machine housing; and one or more display devices at least a part of which is disposed in said gaming machine housing, each display device comprising a structural support;

a display for displaying images that relate to a game that can be played on the gaming machine;

a mechanical reel mounted to the structural support for rotational movement relative to the display, the mechanical reel having a outer periphery defining a plurality of images positions including at least one variable display position at which the display is operable to display content; and an actuator for moving the display between i) a first position in which the display is displaced from the outer periphery of the reel and when in said first position the reel can be rotated, and ii) a second position in which the display is located closer toward the outer periphery of the reel and in registration with the variable display position to display content.

In an embodiment, the gaming machine further comprises a reel controller for controlling the stopping position of the or each reel.

In an embodiment, the gaming machine further comprises an actuator controller which is operable to control movement of the display device between the first and second positions.

In an embodiment, the reel controller and actuator controller communicate such that the actuator controller operates the actuator to move the display from a first position to the second position when the reel is located in a desired stopped.

According to the present invention there is also provided an electronic gaming machine comprising:

a cabinet;

a computer processor;

a plurality of reel assemblies that are at least in part contained within the cabinet, each assembly comprising i) a reel with an outer periphery;

ii) a motor that drives the reel in rotational movement, the computer processor controlling the motors to rotate the reels and position the reels at desired stop positions;

iii) a display unit for displaying images; and iv) an actuator that moves the display and the computer processor controlling the actuator so as to move the display between a retracted position at which the display is displaced from the outer periphery of the reel and an operating position in which the display is located closer to the outer periphery of the reel to allow the images to be observed through the periphery.

According to the present invention there is provided a method of displaying images from a reel of a gaming machine, the reel having a variable display position at which the content of the images being display can be varied, the method comprising the steps of:

a) rotating the reel in response to a player placing a wager;

b) stopping the reel at a desired stop position so as to align the display with the variable display position of the reel;

c) moving the display between a first position in which the display is removed from the reel to allow the reel to be rotated and a second position in which the display is located adjacent to the reel while the reel is located in the stop position; and d) showing an image from the display while the display is located in the second position.

In an embodiment, the method further includes the step of moving the display from the first position to the second position when the reel is stopped in the desired stop position and moving the display from the second position to the first position before rotation of the reel.

BRIEF DESCRIPTION OF SEVERAL VIEWS OF THE DRAWINGS

The present invention will now be described with reference to the accompanying figures, of which.

DETAILED DESCRIPTION OF THE INVENTION

The preferred embodiments shown in the figures relate to a gaming machine and a display device for gaming machines comprising a plurality of mechanical reels, each having at least one variable display position where a display unit may show a still image such as a symbol, an animation, a video or other content. The display unit may additionally be used to impart visual effects at positions on the mechanical reels where there is a symbol such as a printed symbol. A feature common to the embodiments is that the content of the display devices shown at the variable display position on the reel can be changed, and the display unit can be manoeuvred to minimize parallax effects arising from apparent separation between the display unit and the reel. The gaming machine therefore enables electronic gaming machinery technology to be employed while maintaining the appeal and attraction of players to gaming machines having mechanical reels.

Figure 1:
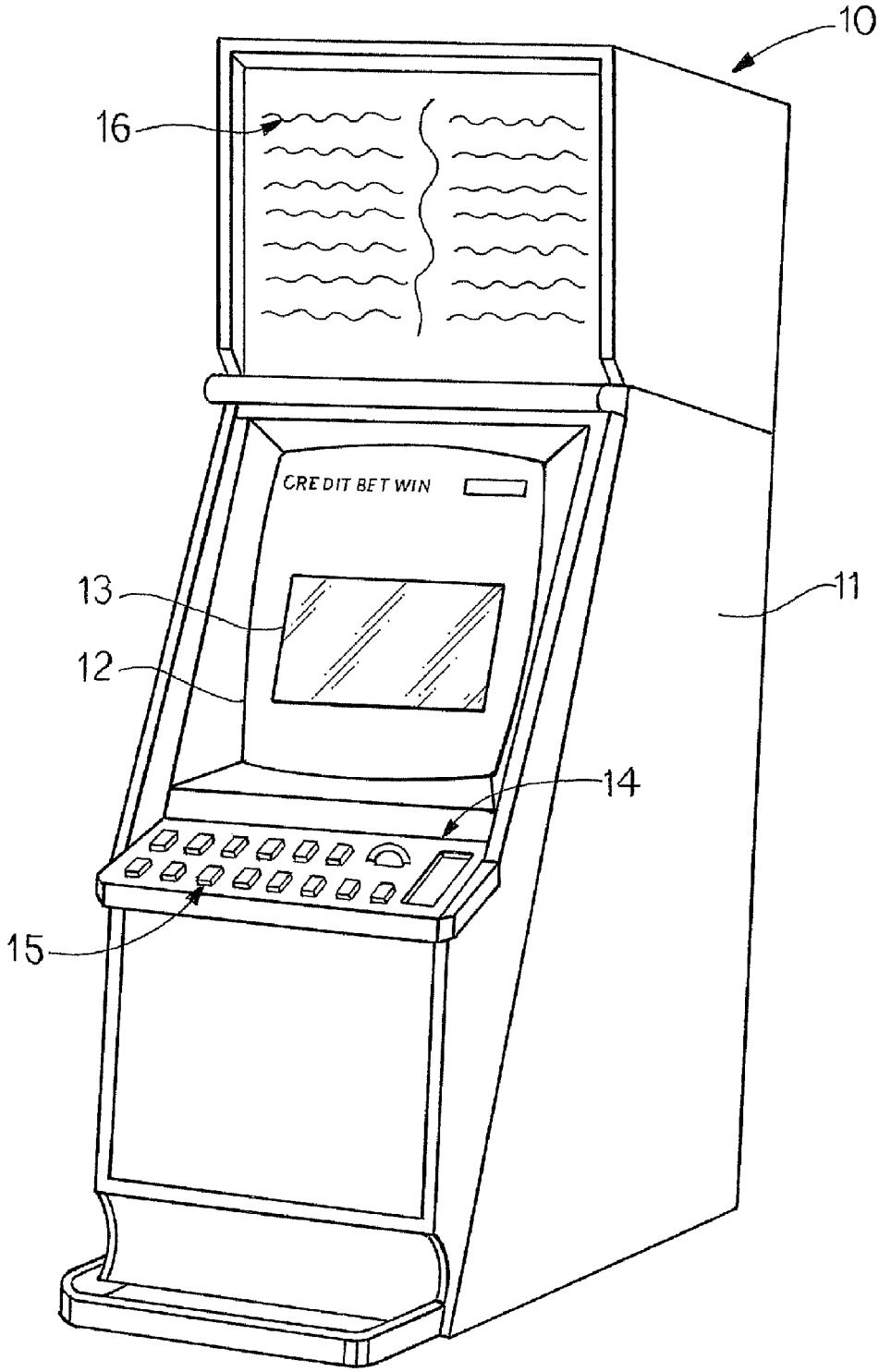
FIG. 1 is a perspective view of a gaming machine according to an embodiment of the invention.

An example of the external physical form of the gaming machine is illustrated in FIG. 1. The gaming machine 10 includes a housing in the form of a cabinet 11 having a glass face 12 with a viewing window 13 that enables the mechanical reels (not shown in the figure) to be viewed. A mid-trim 14 of the gaming machine 10 houses an interface embodied as a back of buttons 15 that enable a player to interact with the gaming machine 10. The gaming machine 10 may also include a multitude of other features including a top box 16 carrying art work including, for example, play tables and details of bonus awards and other information or images relating to the game being played. The top box 16 may also include an electronic display, for example a video display unit such as a cathode ray tube screen, a liquid crystal display, a plasma screen or any other suitable video display.

Figure 2:
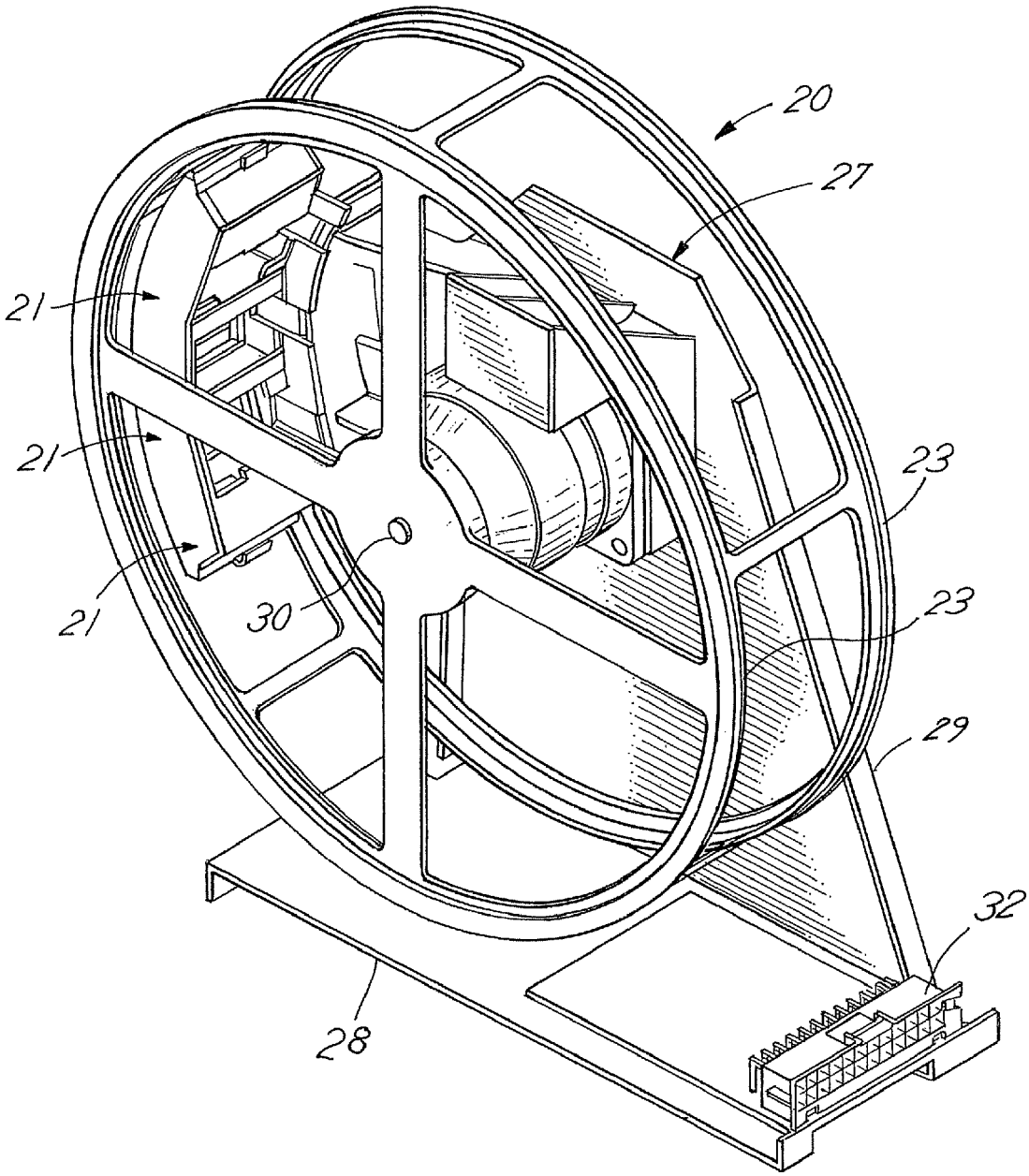
FIG. 2 is a perspective view of a display device according to an embodiment of the present invention.
Figure 3:
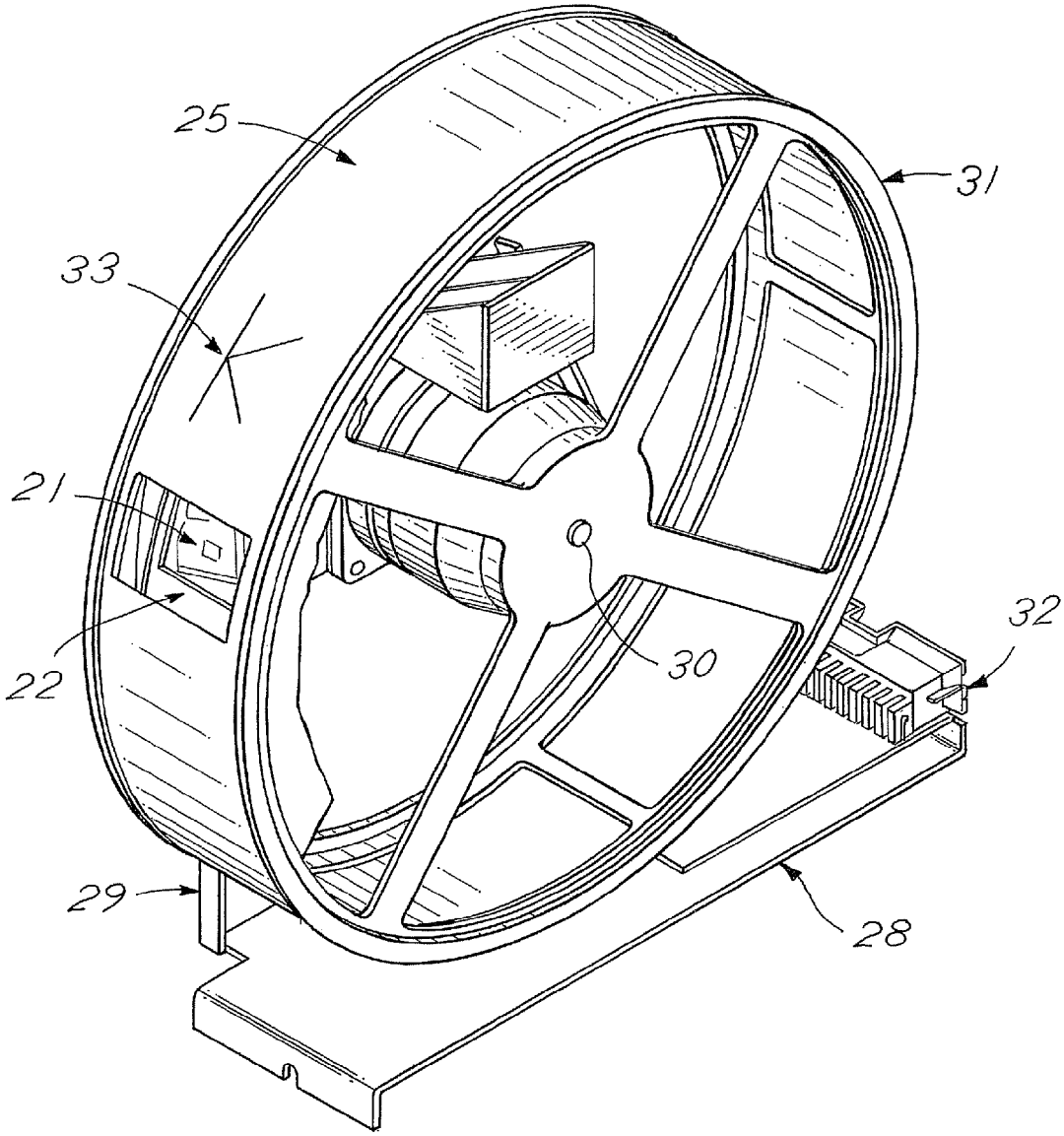
FIG. 3 is a reverse perspective view of the display device shown in FIG. 2.

FIGS. 2 and 3 illustrate a display device according to an embodiment of the present invention in the form of a single mechanical reel 20 having a small electronic display unit 21 arranged to display content at a variable display position on the mechanical wall in the form of a opening 22 (shown in FIG. 3) formed in a periphery 31 of the reel 23 in the form of a window 24 in a reel strip 25. In addition to the opening formed in the reel strip 25, the reel strip itself may also include printed images which, in addition to the content which can be shown on the display, relate to the game being played on the machine. Although not shown in FIGS. 2 and 3, the mechanical reel also includes an actuator for moving the display between a retracted position in which the display is displaced from the reel periphery and an operating position in which the display is located in operative position adjacent to the reel strip. The mechanical reel is preferably driven by a stepper motor 26 which are known in the art. The stepper motor allows the mechanical reel 20 to be moved through a series of incrementally-spaced positions such as 22 stop positions. The mechanical reel 20 can be driven rotationally and stopped at any one of the plurality of stop positions as determined. Each of the stop positions corresponds with a symbol or image position that is used to determine the outcomes of the game. Any form of stop determiner such as, for example, a random number generator or a predetermined control sequence can be used, at least in part, to control operation of the stepper motor and thus rotation of the reels. The gaming machine itself will include a plurality of reels, such as for example 1 to 6 reels mounted in the cabinet of the gaming machine behind the window of the gaming machine.

With reference to FIGS. 2 and 3, the mechanical reel 20 of each display device is mounted to a support structure 27 comprising a base plate 28 which is mounted within the gaming machine cabinet 11 and a side plate 29 extending upwardly from the base plate 28 to which the stepper motor is attached. The reel 20 is mounted for rotational movement about an axle 30 extending from the side plate 29. Power and control signals are supplied through an electrical contactor 32 on the base plate 28. According to one embodiment, a set of symbols are disposed on the reel strip 25, such as the symbol "K" 33 at one or more variable display positions on the reel strip 25.

Depending on the rotational operation of the mechanical reel 20, the mechanical reel 20 can be stopped such that the electronic display unit 21 aligns or registers with the window 24 in the reel strip 25. Thus, the display unit 21 can be used to show or display varying content based on pre-stored image data. Conversely, the reel 20 may also be rotated and stopped at stop positions where the reel strip 25 obscurers from view the display unit 21 and in which case, the symbol printed onto the reel strip 25 at the stop position will form part of the game being played.

Figure 4:
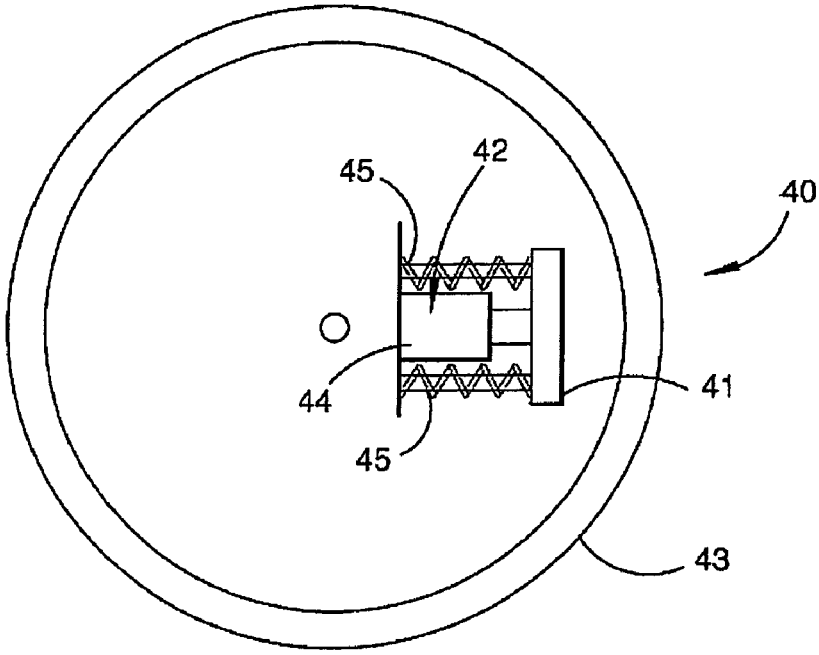
FIGS. 4 and 5 are cross sectional views of a mechanical reel according to an embodiment of the invention including a display unit located in a retracted position and a forward position respectively.
Figure 5:
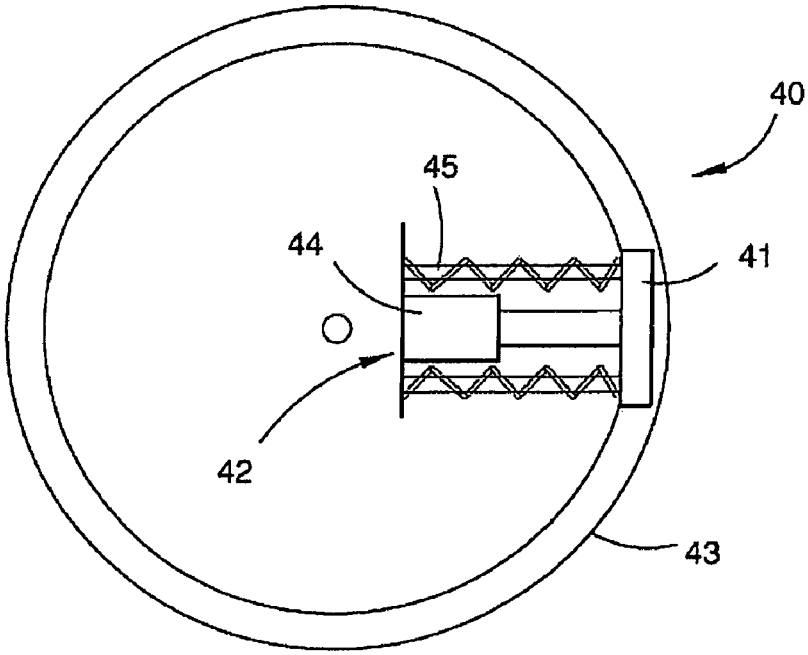

FIGS. 4 and 5 are schematic illustrations of a cross sectional view of a mechanical reel 40 comprising an electronic display unit 41 and an actuator 42 for moving the display unit 41 between two positions. The features of the reel 40, the actuator 42 and electronic display unit 41 may be incorporated into the mechanical reel 20 shown in FIGS. 2 and 3.

With particular reference to FIG. 4, the actuator 42 locates the display unit 41 in a retracted position in which the display unit 41 is displaced from the outer periphery 43 of the reel, thereby allowing rotation of the reel by the stepper motor without interference from the display unit 41. In the case of FIG. 5, the display unit 41 is located in an advanced position in which the display 41 is located adjacent to, or in contact with the outer periphery 43 of the reel 40. In the situation in which the stepper motor stops the mechanical reel with the variable display position over or in alignment with the display 41, the actuator 42 is operable to move the electronic display unit toward the outer periphery 43 of the reel and, indeed, such that the electronic display unit 41 is received within a frame or opening formed within the outer periphery 41. Once located in the advanced position, the electronic display unit 41 can, in addition to displaying other content, display a symbol determining the outcome of a game being played on the machine. Content other than symbols or determining the outcome of the game being played on the machine may include symbols or images that represent rotation of the reels at speed correlating to rotation of the reel and equating to the speed of rotation of adjacent mechanical reels of the gaming machine. In addition, even prior to the display unit being located by the actuator in the window of the reel strip, the display unit 41 may show images or content representing a conventional reel strip having images printed thereon during rotation as if the electronic device was a conventional reel strip.

The actuator 42 may be in the form of any one or a combination of any suitable mechanical, electrical or fluid operated system. For example, the actuator may be in the form of any one or a combination of a ram mechanism including electronic screw mechanisms, hydraulic mechanisms, pneumatic mechanisms or any other mechanism having a linear action; electric motors; springs including compression springs or tensile springs; electromagnetic actuators; rack and pinion mechanisms; block and cable mechanisms; pulling mechanisms; gear mechanisms; gear and chain mechanism; lever mechanisms; sliding mechanisms; pneumatic suction devices or any other mechanism capable of moving the display unit between the retracted and advanced positions. In the case of the embodiment shown in FIGS. 4 and 5, the actuator 42 comprises a central electromagnet unit 44 and a pair of compression springs 45. The electromagnetic unit 44 retracts the display 41 to the position shown in FIG. 4 and the compression springs 45 biases the display toward the forward advanced position as shown in FIG. 5. Movement of the display 41 between retracted and advanced positions may be supported by rails, slides, tracks or any suitable linear member along which the display can travel.

Figure 6:
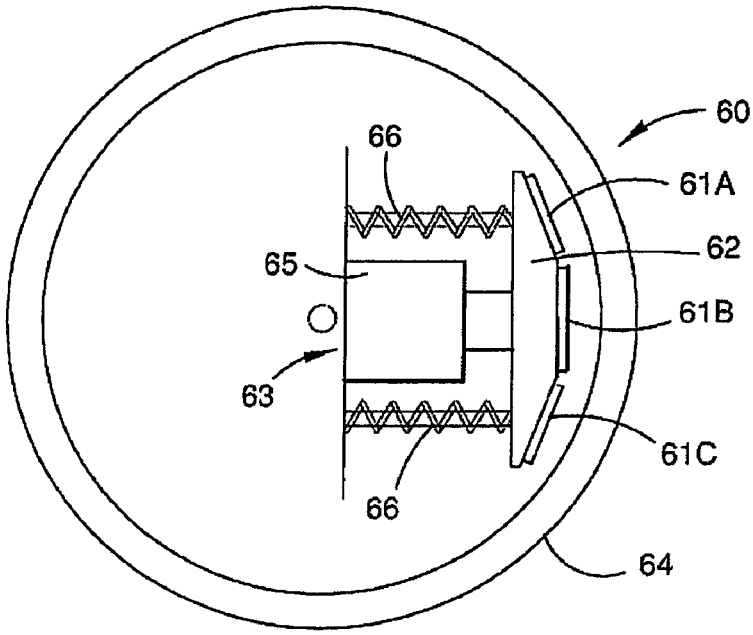
FIGS. 6 and 7 are cross sectional views of a mechanical reel according to an embodiment of the invention comprising a set of three displays that are located in retracted and forward positions respectively.
Figure 7:
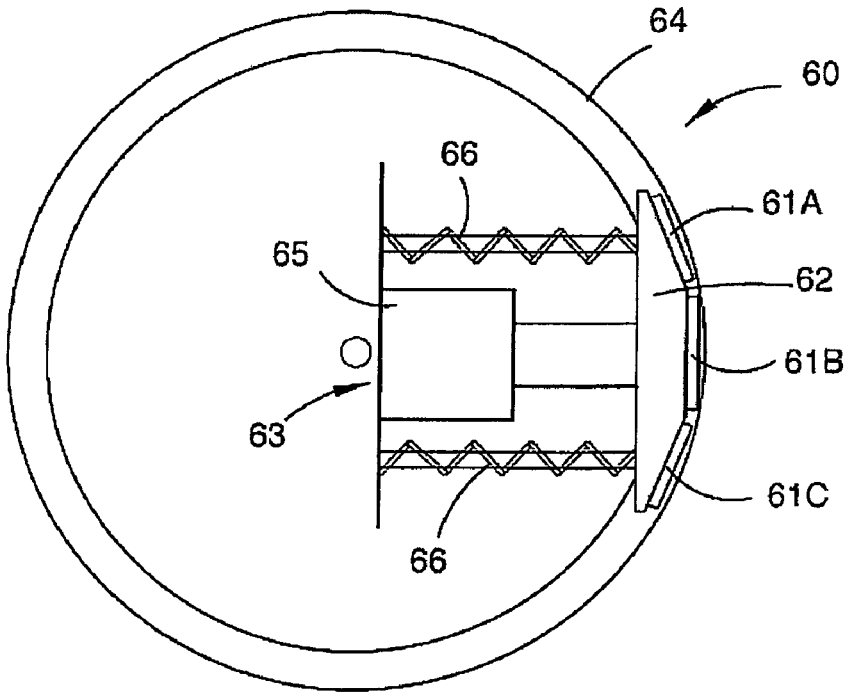

A schematic cross sectional view of a mechanical reel 60 according to an alternative embodiment is illustrated in FIGS. 6 and 7. Again the features of the reel 60, shown in FIGS. 6 and 7 may also be incorporated in the reels shown in FIGS. 2 and 3.

With reference to FIGS. 6 and 7, the reel 60 includes 3 electronic display units 61A, 61B, 61C mounted side-by-side on a platform 62 which, like the embodiment shown in FIGS. 3 and 4, as moved by an actuator 63 so as to move the electronic display units 61A-C between a retracted position as shown in FIG. 6, and an advanced position as shown in FIG. 7 so that displacement between one or move openings in a reel strip 64 and the electronic display units 61A-C is minimised. Rather than the display units 61A-C being moved by a single actuator, separate actuators may be provided for individual display units or multiple display units.

In the case of the embodiment shown in FIGS. 6 and 7, the reel strip 64 may include one or more openings which when the reel is stopped at a desired stop position, one or more of the openings may align with one or more or the three electronic display units 61A-C. In the situation in which the openings do not align or register with any of the display units 61A-C the reel strip 64 will obscure from view the display units 61A-C, and thereby, in effect determine the game being played by the images printed on the reel strip. The actuator 63 of the embodiment shown in FIGS. 6 and 7 may be in the form of any one or a combination of the different types of actuators mentioned above in relation to the embodiment shown in FIGS. 4 and 5. In the case of the embodiment shown in FIGS.

6 and 7, the actuator 63 comprises a central electromagnet unit 65 and a pair of compression springs 66. The electromagnetic unit 65 retracts the display 61 to the position shown in FIG. 6 and the compression springs 66 biases the display 61 toward the forward advanced position as shown in FIG. 7. Movement of the display 61 between retracted and advanced positions may be supported by rails, slides, tracks or any suitable linear member along which the display can travel.

The display units shown in FIGS. 4 and 5, or FIGS. 6 and 7 may be of any suitable form including LCD displays, TFT displays or OLEDs.

Although not shown in FIGS. 5 to 7, the display device may also include support structures comprising a base plate and side plates, wherein the reel is rotatably mounted on an axle extending from the side plate. A stepper motor may also be used to drive the reels in rotational movement.

Figure 8:
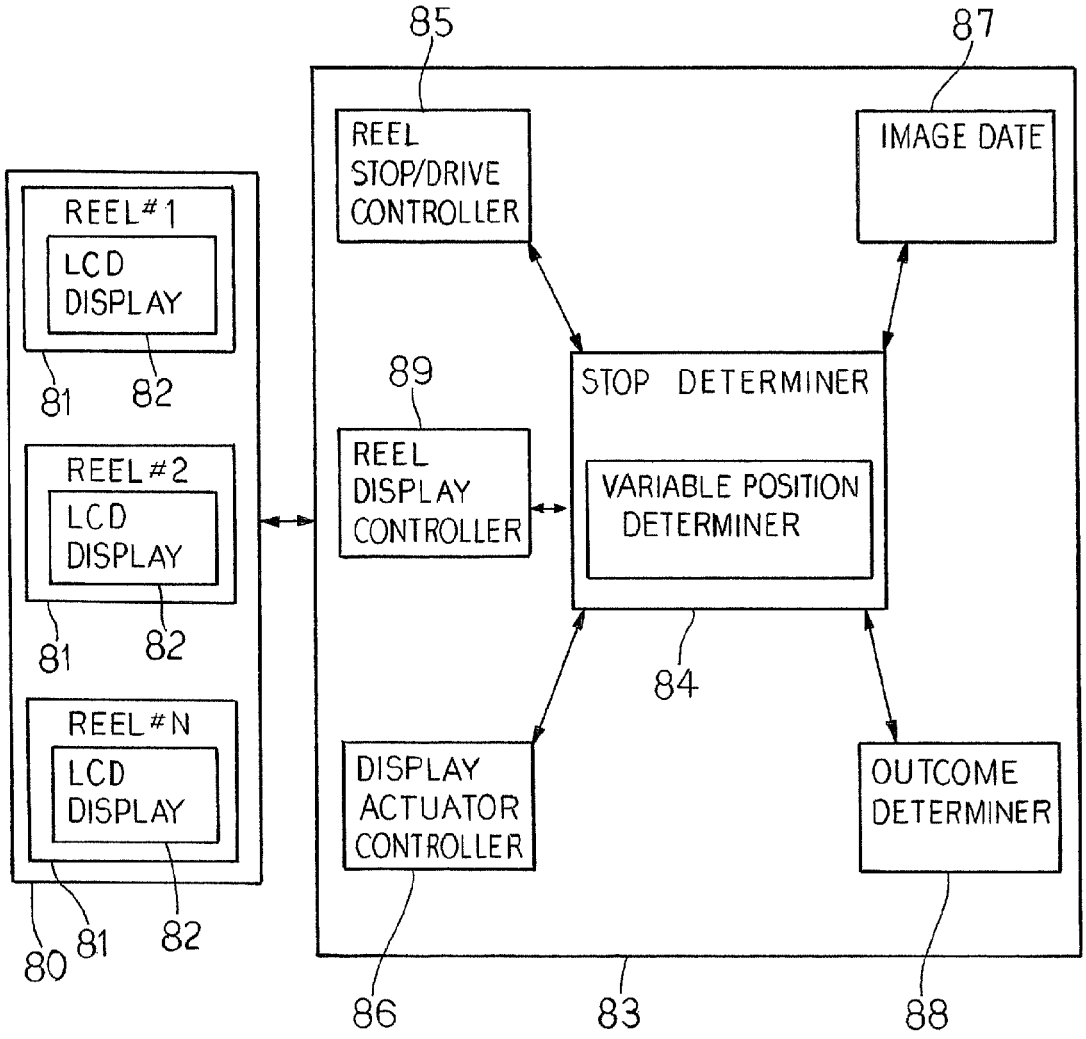
FIG. 8 is a block diagram illustrating components of the gaming machine or the display devices according to the embodiments shown in FIGS. 1 to 7.

FIG. 8 is a block diagram illustrating the principal functional components of a display device or a gaming machine comprising display devices such as those shown in FIGS. 1 to 7. The block diagram is a specific example in which multiple display devices, each having a single reel or a single display device 80 comprising multiple reels 81. The reels 81 each include one or more electronic display units 82 that are manoeuvred by an actuator 86 in the sense of the embodiments shown in FIGS. 4 to 7. Operation is controlled by a game controller 83 which is in data communication with player interface, such as display units 82, and typically includes a processor that processes the game play instructions in accordance with game play rules and outputs game play outcome data to the display units. Typically, the game play instructions are stored in a memory but can also be hardwired. It will be understood that the term "processor" is used to refer generically to any device that can process game play instructions in accordance with game play rules and may include: a microprocessor, microcontroller, a programmable logic device or other computational device, a general purpose computer such as for example a PC or a server.

The game controller 83 comprises a stop determiner 84 incorporating a random mechanism, such as a random number generator or a mapping system to modify the odds of particular outcomes. The stop determiner controls the selection of the stop position of the mechanical reels and in turn the stop controller 85 of the stepper motors that stops the reels 81 at the desired stop position. Specifically when, the stop determiner 84 communicates to the controller 85 of the stepper motor to stop of the reel 81 with the variable stop position of the reel 81 in alignment or in registration with one or more of the display units 82, for example, when the variable display position is located in an winning line, an actuator controllers 86 are operable to move the display units 82 to minimise apparent parallax effects between the periphery of the reels 81 and the display units 82. For example, in the situation in which a player places a wager, the reels 81 are rotated and the stop determiner 84 selects the stop position of the reels 81 and the variable display position is located over the display units 82, the actuator controller 86 is operable so that the actuators move the display units 82 from a first position at which the display units are removed from the periphery of the reel 82 to a second position at which the display is located adjacent to the periphery of the reel 82. Image data 87, selected by an outcome determiner 88 is communicated to the display units 82 via a reel display controller 89 and displayed to the player. If the player is to continue with the game, the actuator controller 86 is operable to move the display units 82 away from the reels 81 and allow rotation of the reels 81.

It will be appreciated that many modification and variations may be made to the embodiments of the invention described above without departing from the spirit and scope of the present invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A display device for a gaming machine comprising:
a structural support;
a display for displaying images that relate to a game that can be played on the gaming machine;
a mechanical reel mounted to the structural support for rotational movement relative to the display, the mechanical reel having a outer periphery defining a plurality of image positions including at least one variable display position at which the display is operable to display content; and
an actuator for moving the display between i) a first position in which the display is displaced from the outer periphery of the reel, and ii) a second position in which the display is located closer toward the outer periphery of the reel and in registration with the variable display position to display content, and
wherein the first position is a retracted position in which the display is displaced inwardly toward a central axis about which the outer periphery of the reel rotates.

2. The display device according to claim 1, wherein when the display is in said first position the reel can be rotated.

3. The display device according to claim 1, wherein the second position is an advanced position in which the display is located adjacent to the outer periphery of the reel.

4. The display device according to claim 1, wherein the outer periphery of the reel is defined by a peripheral wall and the variable display position of the outer periphery defines an opening in the peripheral wall and when the display is located in the second position, the display is received by the opening.

5. The display device according to claim 4, wherein the display is located inside an outermost face of the peripheral wall when located in the second position.

6. The display device according to claim 1, wherein at least part of the display is planar with an outermost face of the peripheral wall when located in the second position.

7. The display device according to claim 1, wherein the display is selected from the group comprising a TFT, and OLED and an LCD.

8. The display device according to claim 1, wherein the reel comprises a plurality of variable display positions.

9. The display device according to claim 1, wherein the display device comprises a plurality of displays.

10. The display device according to claim 1, wherein the actuator is any one or a combination of: a ram mechanism include an electronic screw mechanism, hydraulic mechanism or pneumatic mechanism; an electric motor; a spring including a compression spring or tensile spring; an electromagnetic actuator; a rack and pinion mechanism; a block and cable mechanism; a pulley mechanism; a gear mechanism; a gear and chain mechanism; a lever mechanism; a sliding mechanism; a pneumatic or suction mechanism or any other drive mechanism capable of moving the display between first and second positions.

11. The display device according to claim 1, further comprising an actuator controller that is operable to move the display between the first and second positions in co-ordination with rotation of the reel and stopping of the reel.

12. The display device according to claim 11, wherein the actuator controller is operable to move the display from the first position to the second position when the reel is located in a desired stop position.

13. The display device according to claim 12, wherein when the reel is located in the desired stop position and the display located in the second position, prior to rotation of the reel, the actuator controller is operable to move the display from the second position to the first position.

14. The display device according to claim 11, wherein the display device comprises a stepper motor that drives the mechanical reel and a drive controller is operable to stop the mechanical reel at a desired stop position.

15. The display device according to claim 14, wherein the drive controller and actuator controller communicate such that the actuator controller moves the display from the first position to the second position when the drive controller has stopped the reel at a desired stop position.

16. The display device according to claim 1, wherein the display device comprises a stop mechanism arranged to stop the mechanical reel at a desired position.

17. The display device according to claim 1, wherein the display device comprises a driver to drive the reel for rotational positioning relative to the display.

18. The display device according to claim 1, wherein the structural support comprises a first support member to which the mechanical reel is mounted and a second support member to which the display is mounted.

* * * * *